United States Patent [19]

Davis et al.

[11] 4,320,961

[45] Mar. 23, 1982

[54] JAM DETECTING APPARATUS AND METHOD FOR ELECTROSTATIC COPIER

[75] Inventors: Austin E. Davis; Raymond G. Cormier, both of Nashua; Peter M. Coombs, Wilton, all of N.H.

[73] Assignee: Nashua Corporation, Nashua, N.H.

[21] Appl. No.: 115,715

[22] Filed: Jan. 28, 1980

[51] Int. Cl.[3] ..... G03G 15/00

[52] U.S. Cl. ..... 355/14 SH; 271/258; 355/77

[58] Field of Search ..... 355/14 R, 14 SH, 3 R, 355/77; 271/258, 259, 263

[56] References Cited

U.S. PATENT DOCUMENTS

| | | | |
|---|---|---|---|
| 3,169,476 | 2/1965 | Fielding | 101/247 |
| 3,186,708 | 1/1965 | Hinz | 271/259 |
| 3,335,662 | 8/1967 | Ritzerfeld | 101/235 |
| 3,360,652 | 12/1967 | Bernous | 250/219 |
| 3,586,450 | 6/1971 | Hosey et al. | 355/14 R |
| 3,603,585 | 9/1971 | Maloney et al. | 271/259 |
| 3,650,617 | 3/1972 | Baxter et al. | 355/3 R |
| 3,693,969 | 9/1972 | Sakamaki et al. | 355/14 R |
| 3,734,604 | 5/1973 | Szostak et al. | 355/14 R |
| 3,878,540 | 4/1975 | Kawai | 271/259 X |
| 3,970,384 | 7/1976 | Yamamoto et al. | 355/14 R |
| 4,032,228 | 6/1977 | Whited | 271/258 X |
| 4,054,380 | 10/1977 | Donohue et al. | 355/14 R |
| 4,110,032 | 8/1978 | Hubbard et al. | 271/258 X |
| 4,139,300 | 2/1979 | Katayama et al. | 355/14 R |
| 4,179,211 | 12/1979 | Kimura et al. | 355/14 R |
| 4,239,372 | 12/1980 | Iwai | 355/14 R |
| 4,244,648 | 1/1981 | Schultes et al. | 271/258 |

*Primary Examiner*—Richard L. Moses

*Attorney, Agent, or Firm*—Kenway & Jenney

[57] ABSTRACT

A method and apparatus are described for correcting a jam condition in a photocopier, the copier having a transfer station at which a developed image is transferred from a moving photosensitive surface onto a sheet material and a cleaning station having a cleaning blade bearing against the width of the photosensitive surface. The apparatus has energy transmitting and receiving elements which detect the presence of unremoved sheet material on the photosensitive surface between the transfer station and the cleaning station and provides for continued movement of the photosensitive surface until the sheet material strikes the cleaning blade. In this way, a buckle is formed in the sheet material between the cleaning station and the transfer station which facilitates removal of the sheet from the copier.

8 Claims, 4 Drawing Figures

JAM DETECTING APPARATUS AND METHOD FOR ELECTROSTATIC COPIER

BACKGROUND OF THE INVENTION

This invention relates generally to photocopiers and in particular to an apparatus and method for correcting a paper misfeed in such copiers.

One of the mechanical problem areas of major concern to the copier industry is the misfeeding or jamming of copy sheet material. In normal operation, a sheet of copy material is applied against the photosensitive surface, most often the outer perihery of a drum-shaped member, and the image is transferred to the sheet. The sheet thereafter is removed from the drum and either dried or fused, depending upon the particular development process which is used. A jam condition can, for example, occur just after the step of the copying process when a developed image on the moving photosensitive surface is transferred to a sheet of copy material. In the jam or misfeed condition, a "pick-off" of the sheet material is missed and the copy sheet improperly remains on the photosensitive surface.

Such a condition must be detected and corrected so that the photosensitive surface and the operating stations adjacent the photosensitive surface, are neither damaged nor rendered inoperable due, for example, to toner contamination. To this end, there may exist many techniques for detecting the undesired presence of sheet material, or its absence, at one or more processing stations in the copier.

In most typical situations when the copier control circuitry is "informed" that a misfed sheet has occurred, the photosensitive surface immediately is rendered inoperative by a braking procedure, the copier is shut down, and either the operator or a service man must correct the jam condition by removing sheet from the copier. When the jam involves paper adhering to the drum member, that is a failure in the "pick-off" mechanism, it may be necessary to remove the drum from its mount, a procedure best performed by trained technicians. The down-time of the copier and the service call are expensive to the user.

In an attempt to avoid this expense of both time and money, several techniques have been developed to avoid the need for a service call. Thus, for example, the detection of the misfeed may operate to enable a back-up sheet removal system to strip the sheet from the photosensitive surface. In these systems, however, although the paper is removed from the drum, the equipment is complex, sensitive to dimensional variations, and increases the physical size of the copier system.

In the 1970's, liquid transfer development systems were first introduced commercially. These systems employ a developer consisting of a clear liquid containing finely divided toner particles. This development system differs significantly from earlier commercial systems wherein the toner was a dry mixture of carrier particles and a toner material. The liquid developer system concept has most often been applied to small, relatively low-cost machines, and hence, it is not economically feasible to provide a back-up sheet removal system due to the dual requirements of added physical space and additional expense. Thus, machines employing a liquid developer, wherein the copy sheet tenaciously adheres to the wet photosensitive surface, provide added incentives to improve the jam detection and paper removal techniques.

It is, therefore, a principal object of this invention to provide a sheet detection and clearance apparatus and method for a photocopier wherein paper improperly adhering to a photosensitive surface after "pick-off" failure can be quickly and easily cleared. A further object of the invention is to provide a paper jam detection and clearance apparatus and method which are reliable, simple to operate and use, low in cost, which do not require complex apparatus, and can make use of existing apparatus on the copier. A still further object of the invention is to provide such an apparatus and method which are particularly useful in liquid toner transfer systems, and which provide an operator with easy access to the sheet material to be removed when a jam condition occurs.

SUMMARY OF THE INVENTION

The invention relates to a method and an apparatus for detecting and correcting a sheet jam condition in a photocopier. The copier has a transfer station and a cleaning station in proximity to a moving photosensitive recording surface, preferably, the surface of a rotating drum member, with the cleaning station having a wiper blade extending across and in pressure contact with this surface. The method features the steps of detecting the presence of the sheet material on the photosensitive recording surface at a position past the transfer station and ahead of the cleaning station wiper blade. The method further features the step of terminating movement of the photosensitive surface a selected time duration after the sheet presence is detected. The time duration is of a magnitude such that the sheet at least reaches the cleaning station wiper blade before the photosensitive surface movement stops, whereby a buckle forms in the sheet between the cleaning station and the transfer station. This facilitates easy removal of the sheet material from the copier, since the buckled portion of the sheet material is out of contact with the photosensitive surface.

In the preferred embodiment of the invention, the detecting step includes providing a pivotable infrared energy-transmitting and receiving assembly opposite the photosensitive surface between the transfer station and the cleaning station wiper blade, and pivoting the infrared assembly to an operative position adjacent to, but not in contact with, the photosensitive surface. The method further features the step of pivoting the infrared assembly to an inoperative position spaced away from the photosensitive surface whereby a detected and buckled sheet material may be removed from the photosensitive surface without damaging the assembly.

The apparatus of the invention relates to a photocopier having a transfer station for transferring a developed image from the photosensitive recording surface onto a sheet material and removing the sheet material from the surface. The copier also has a cleaning station for removing the developer material remaining on the photosensitive surface after transfer, the cleaning station having a wiper blade extending across, and adapted to be positioned in pressure contact with, the width of the photosensitive surface. The apparatus of the invention detects sheet material remaining on the photosensitive recording surface of the copier after transfer. The apparatus has an energy transmitting and receiving assembly, means for supporting the assembly between the transfer station and the cleaning station of the copier, and electrical circuitry responsive to a signal output of the assembly for providing a detection signal output for indicating the presence of sheet material on the photosensitive surface between the transfer station and the cleaning station. The apparatus features a delay circuit responsive to the assembly output signal for providing a delayed output signal. The electrical circuitry further includes circuitry responsive to the delayed output signal for terminating movement of the photosensitive surface. The delay time duration is sufficiently long to enable at least the leading edge of the sheet material to contact the cleaning wiper blade prior to termination of the photosensitive surface movement. Thereby, a buckle is created in the sheet material between the transfer station and the cleaning station wiper blade for facilitating removal of the sheet material from the copier.

In a preferred embodiment of the invention, the apparatus further features a linkage for pivoting the assembly from an operative position adjacent, but not in contact with, the photosensitive surface to an inoperative position spaced from the surface whereby sheet removal is facilitated when the assembly is in the inoperative position. The apparatus further features a transmitting and receiving assembly which operates in the infrared range and at least one field of view limiting element extending from the infrared assembly toward the photosensitive surface for limiting the field of view of the infrared assembly and for protecting a transmitting and a receiving element surface from being covered with developer material which remains on the photosensitive surface during normal operation of the copier.

DESCRIPTION OF THE DRAWINGS

Other objects, features and advantages of the invention will appear from the following description of a preferred embodiment of the invention taken together with the drawings in which.

DESCRIPTION OF THE PREFERRED EMBODIMENT

Figure 1:
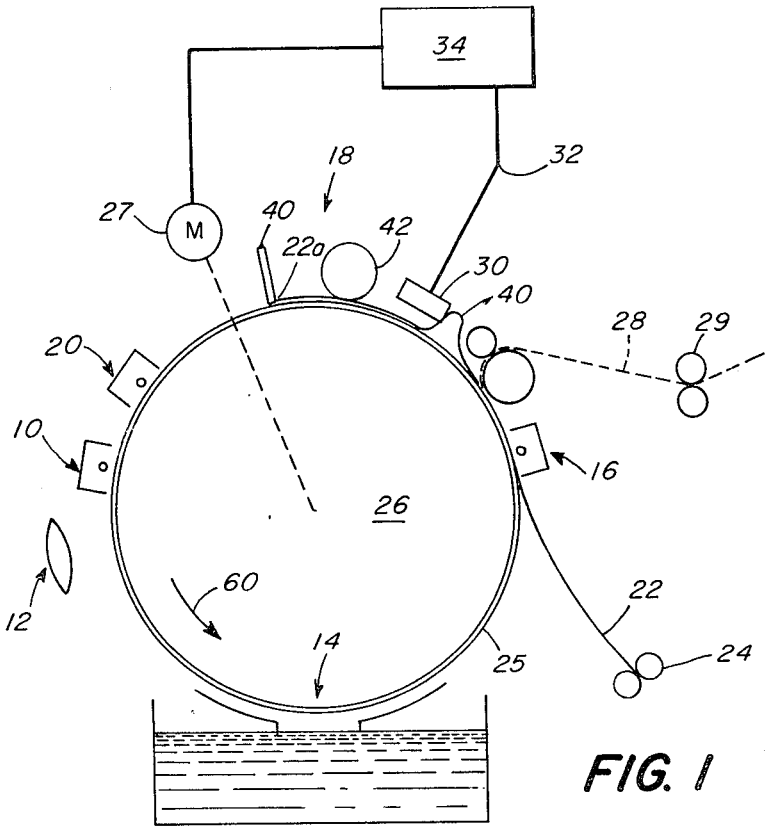
FIG. 1 is a schematic representation of a liquid toner transfer copier system according to the invention showing a typical placement of the sheet detector assembly.

Referring to FIG. 1, a liquid-toner photocopier typically has a charging station 10, an exposure station 12, a development station 14, a transfer station 16, a cleaning station 18, and a charge neutralizing station 20. A sheet of copy material 22, for example plain bond paper, is typically fed from a sheet feeding assembly 24 toward the transfer station 16. At the transfer station, the sheet is applied to a moving photosensitive surface 25, for example in the form of a selenium layer on the outer surface of a rotating drum 26 driven by a motor 27, and on which surface 25 there is a film of liquid toner defining a developed image. The charged toner particles are electrostatically attracted to the sheet at the transfer station and the toned image is thereby transferred to the sheet. A "pick-off" apparatus (not shown) removes the sheet from the photosensitive surface 25 and directs it along a path 28 shown in phantom toward a sheet discharge assembly 29, whereby the copy sheet is delivered to the copier exit pocket. If the copy sheet is not removed from the photosensitive surface 25, according to the invention, it is detected as a copy sheet leading edge 22*a* passes beneath a sheet detection assembly 30 positioned between the transfer station and the cleaning station. The sheet detection assembly 30 provides an output signal over its output lines 32 to electrical circuitry 34, which in one state indicates the undesired presence of the sheet 22. In response to this one state of the signal on lines 32, the electrical circuitry 34 terminates rotation of the drum 26 by stopping the drive motor 27, and renders the electrostatic copier inoperative for making further copies until the missed sheet is removed and the copier is reset.

The cleaning station 18 typically includes a cleaning blade 40 and a cleaning roller 42. The cleaning blade contacts the photosensitive surface 25 across its width, in a direction normal to its surface, and applies a pressure against the surface. According to the invention, after the detection of the undesired sheet 22 on the photosensitive surface 25 by the sheet detection assembly 30, a predetermined delay is provided so that the leading edge 22*a* can contact the blade 40, whereby the sheet leading edge is stopped and a buckle 46 is formed in the sheet material at a position between the cleaning blade 40 and the transfer station 16. This buckle is spaced away from the photosensitive surface 25 and is made accessible to the operator upon the opening of a top panel (not shown) of the copier, so that the "jammed" sheet can be easily removed thereby. For facilitating removal of the sheet material, the sheet detection assembly 30 is mounted for pivotable movement in an upward direction to an inoperative position whereby it will neither interfere with the removal of the sheet nor be damaged thereby.

Figure 2:
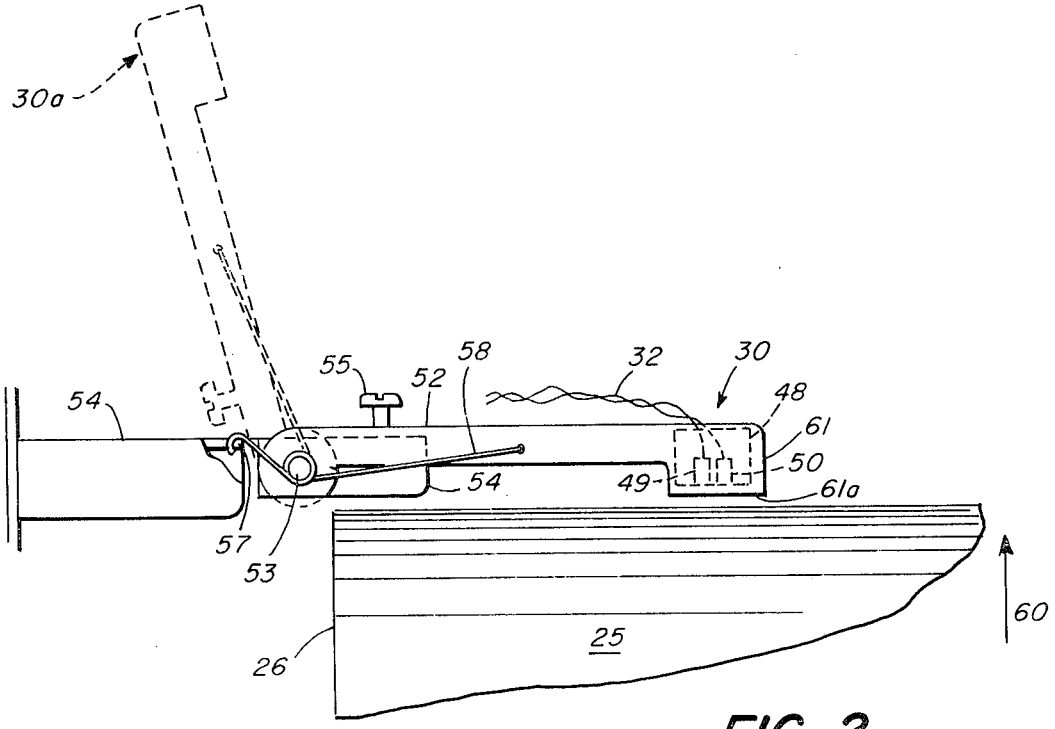
FIG. 2 is a side elevation view of the detector assembly in position adjacent the photosensitive surface.

Referring to FIG. 2, the sheet detection assembly 30 has a transducer 48 having, in the illustrated embodiment, individual transmitting and receiving elements 49, 50 respectively (see FIG. 3) attached to, and extending downwardly from, a support arm 52. The support arm 52 is pivotably fastened by a pin 53 to a bracket 54 which in turn attaches to a convenient location on the copier chassis. In this operative position the illustrated transducer typically is spaced ¾ inch away from the photosensitive surface 25. An adjustment screw 55 whose bottom end protrudes through the support arm 52 and bears against the bracket 54, can be adjusted to vary the distance between the transducer 48 and the photosensitive surface 25 to optimize the operation of the transducer. In the illustrated embodiment, the support arm 52 pivots about an axis 53 which is parallel to a line tangent to the photosensitive surface 25 at a position directly beneath the transducer 48. The bracket 54 provides a stop portion 57 against which the pivoting support arm 52 rests when it is in the upward inoperative position (shown in phantom lines at 30*a*). A torsion spring 58 urges the support arm toward the operative position.

Figure 4:
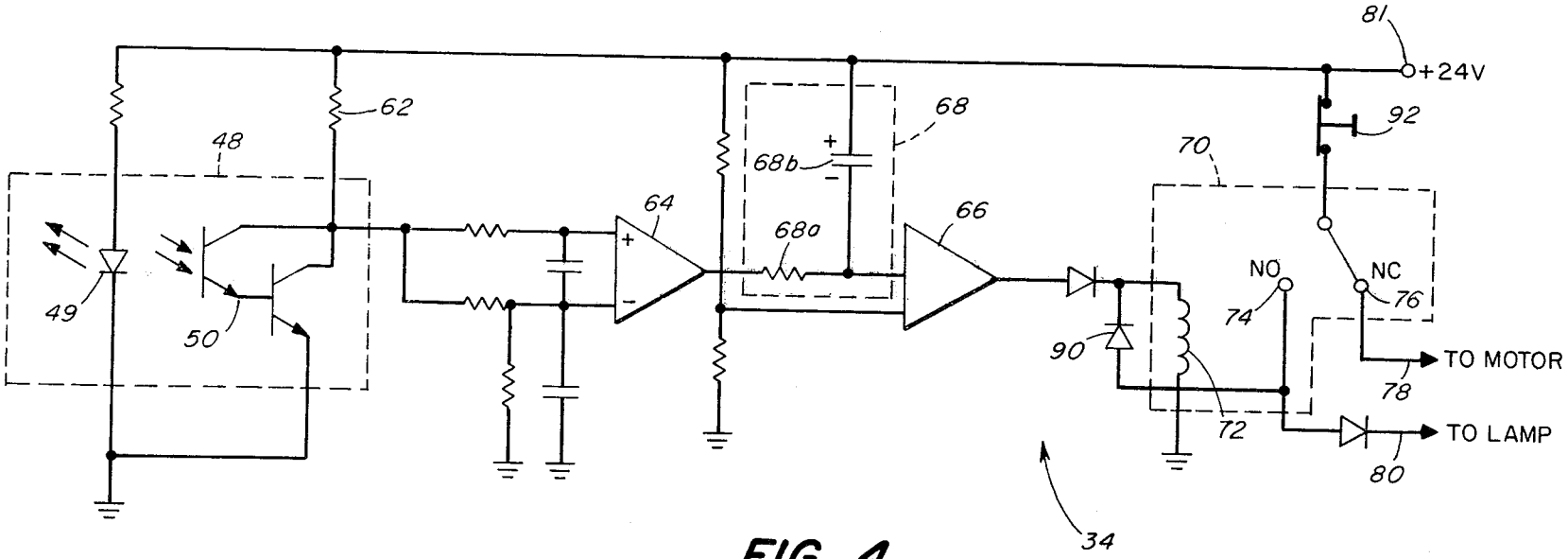
FIG. 4 is a preferred electrical circuit diagram according to the invention.

The transducer 48 is directed downwardly at the photosensitive surface 25 of the drum 26 and is connected through wires 32 to the electrical circuitry 34 (see FIG. 4). Preferably, the transducer 48 is an infrared device which transmits an infrared energy signal through a transmitting element 49 toward the photosensitive surface and receives the reflected signal through the receiving element 50. When there is no paper on the photosensitive surface beneath the transducer, the signal reflected from the surface is exceedingly small because of the infrared-absorbing characteristic of the selenium surface. However, when a sheet of copy material is beneath the transducer, the amount of reflection increases significantly and the large signal received by element 50, as described below, is reflected in the electrical signal level to the circuitry 34.

Figure 3:
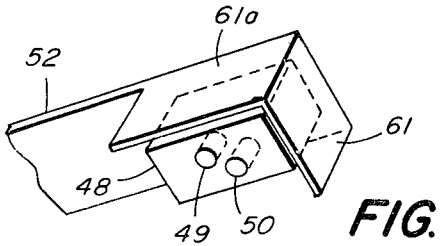
FIG. 3 is an enlarged fragmentary view of the transmitting and receiving assembly, showing the placement of the infrared transducer.

The necessary close proximity of the transducer assembly to the photosensitive surface causes the transmitting and receiving elements to be susceptible to having liquid toner splashed onto their optical surfaces from the photosensitive surface which is rotating in the direction of an arrow 60. Referring to FIG. 3, it can be seen that an end shield 61 and a side shield 61*a* are provided on the support arm 52. These shields, when the detector assembly is in the operative position (see FIG. 2), extend down toward the photosensitive surface, beyond the bottom surface of the transducer, and deflect toner from the photosensitive surface away from the transducer optics. Shields 61 and 61*a* also serve a secondary purpose, that is, restricting the field of view of the transducer, so that the receiving element 50 is less likely to receive spurious signals reflected from areas other than the portion of the photosensitive surface being monitored.

Referring now to FIG. 4, the illustrated infrared transmitting element 49 is an infrared light-emitting diode (LED), and the receiving element 50 is an infrared-sensitive photo-Darlington transistor. The amount of collector-to-emitter current flowing through the photo-Darlington is directly related to the intensity of infrared light incident on its light-sensitive surface. This collector-to-emitter current produces a voltage drop across a resistor 62, and both the magnitude and duration of this voltage drop determine the width of an output pulse produced by an amplifier 64 in response thereto. Thus the width of this output pulse ultimately depends on the intensity and duration of the reflected infrared signal.

The output pulse from the amplifier 64 is an input to a second amplifier 66 via a filter circuit 68. The values of a resistor 68*a* and a capacitor 68*b* within the filter circuit are selected so that only a pulse whose width extends a predetermined threshold value can generate an output change from the amplifier 66. The threshold value can be exceeded only by pulses produced in response to the relatively large amount of light reflected from a sheet of copy material, and this insures that a noise burst or another extraneous, short-lived signal will not actuate the amplifier 66.

Once the amplifier 66 is "triggered", it switches from a normally grounded output state to a high output level to drive a relay 70 through a coil 72. The relay 70 has a normally open contact 74 and a normally closed contact 76. When the coil 72 is energized, a motor control line 78 which communicates with the drive motor 27 (see FIG. 1) is disconnected and as a result the rotation of the drum ceases. In addition, a lamp control line 80 is connected to a voltage source 81, in this instance 24 volts, and a lamp indicator (not shown) is lit.

The values of the resistor 68*a* and the capacitor 68*b* also provide the required RC time-constant to delay "triggering" of the amplifier 66 until the leading edge of the sheet of copy material reaches the cleaning blade (see FIG. 1). The amount of time delay depends on several factors including, for example, the rate of rotation of the photosensitive surface, and the response time of the photo-Darlington transistor.

It should also be noted that in this configuration, the relay 72 is self-latching. That is, when the normally open contact 74 is connected to the voltage source, a loop is completed whereby the relay coil 72 is energized by the voltage source 81 via a diode 90 and remains energized even after the output of the amplifier 66 stops. The self-latching provision is removed when the paper jam is cleared and a pushbutton 92 (normally closed) is depressed, thereby disconnecting the relay coil from the voltage source 81 and returning the relay to its normally open configuration.

SUMMARY OF THE MAJOR ADVANTAGES OF THE INVENTION AND NON-OBVIOUSNESS

A careful consideration of the features of the present invention will reveal several distinguishable advantages over devices and teachings of the prior art.

The present invention provides a simple detection device which can be adapted easily to the previously existing structure of a typical photocopier to produce an efficient system for preventing the damaging effects of copy material adhering to the fragile photosensitive surface of the copier. The invention avoids elaborate and expensive back-up mechanisms for stripping a residual sheet of copy material from the photosensitive surface, and instead provides apparatus for passively sensing the condition of the surface and terminating the operation of the copier when an unremoved sheet is in a convenient position for manual removal. No unnecessary, potentially damaging contact with the photosensitive surface is required.

The typical copier electrical circuitry generally can accommodate the detector circuitry easily, and the low power consumption of the detector has no appreciable effect on the operating cost of the copier. The small physical size of the detector assembly, its ability to be moved manually to an inoperative position and the lack of physical connection to the copier drive system serve to minimize any obstruction to the routine maintenance or repair of the copier.

The disclosed apparatus is different than and distinguishable from the structures and methods disclosed by the prior art. Those prior art references, such as Steiner U.S. Pat. No. 3,791,729 do not generate, in response to the light reflected from a copy medium on the photosensitive surface, a delay before actuating potential jam correcting structure. That delay is essential to the proper operation of the present invention.

Modifications of the disclosed embodiment are contemplated and would be within the scope of the invention. For example, sensing devices which use light of different wavelengths than those of the infrared spectrum could be used to detect the presence of the copy material. The particular electronic circuitry to achieve the transmission and delay of the detector signal may be replaced by functional equivalents. The configuration of the shields used to prevent splashing of toner onto the transmitting and receiving elements can be changed to conform to the physical arrangement of a particular copier.

Thus additions, subtractions, deletions and other modifications of the disclosed embodiment will be obvious to those skilled in the art and are within the scope of the following claims.

What is claimed is:

1. A method for correcting a sheet jam condition in a photocopier having a transfer station and a cleaning station, said cleaning station having at least a wiper blade extending across, and adaptable for pressure contact with, a moving photosensitive recording surface, the method comprising the steps of:

detecting the presence of a sheet material on the photosensitive recording surface at a position between the transfer station and the cleaning station wiper blade;

forming a buckle in said sheet between said transfer station and said cleaning station wiper blade; and terminating movement of said photosensitive surface a selected time duration after said sheet presence is detected, said time duration having a magnitude sufficient to enable said sheet material to at least contact said cleaning station wiper blade before movement of said photosensitive surface terminates, whereby said buckle forms in said sheet between said transfer station and said cleaning station wiper blade for facilitating removal of said sheet material from said copier, said buckle comprising a portion of said sheet material out of contact with said photosensitive recording surface.

2. A method for correcting a sheet jam condition in a photocopier having a transfer station and a cleaning station, said cleaning station having at least a wiper blade extending across, and adaptable for pressure contact with, a moving photosensitive recording surface, the method comprising the steps of:

detecting the presence of a sheet material on the photosensitive recording surface at a position between the transfer station and the cleaning station wiper blade including the steps of providing a pivotable infrared energy transmitting and receiving assembly opposite the photosensitive surface between said transfer station and said cleaning station wiper blade, and pivoting said infrared assembly to an operative position adjacent, but not in contact with, said photosensitive surface; and terminating movement of said photosensitive surface a selected time duration after said sheet presence is detected, said time duration having a magnitude sufficient to enable said sheet material to at least contact said cleaning station wiper blade before movement of said photosensitive surface terminates, whereby a buckle forms in said sheet between said transfer station and said cleaning station wiper blade for facilitating removal of said sheet material from said copier, said buckle comprising a portion of said sheet material out of contact with said photosensitive recording surface.

3. The method of claim 2 further comprising the step of pivoting said infrared assembly to an inoperative position spaced away from said photosensitive surface whereby a detected and buckled sheet material may be removed from the photosensitive surface without damaging said assembly.

4. A method for correcting a sheet jam condition in a photocopier having a transfer station and a cleaning station, said cleaning station having at least a wiper blade extending across, and adaptable for pressure contact with, a moving photosensitive recording surface, the method comprising the steps of:

providing a pivotable infrared energy transmitting and receiving assembly opposite the photosensitive surface between said transfer station and said cleaning station wiper blade for detecting the presence of a sheet material on said photosensitive recording surface;

terminating movement of said photosensitive surface a selected time duration after said sheet presence is detected, said time duration having a magnitude sufficient to enable the sheet material to at least contact said cleaning station wiper blade before movement of said photosensitive surface terminates; and pivoting said infrared assembly to an inoperative position spaced away from said photosensitive surface, whereby a buckle forms in said sheet material between said transfer station and said cleaning station wiper blade for facilitating removal of said sheet material from said copier, said buckle comprising a portion of said sheet material out of contact with said photosensitive recording surface, and whereby said detected and buckled sheet material may be moved from the photosensitive surface without damaging said assembly.

5. In a photocopier having a transfer station for transferring a developed image from a photosensitive recording surface onto a sheet material and then removing the sheet material from said photosensitive surface, a cleaning station for removing developer material remaining on said photosensitive surface after transfer, said cleaning station having a wiper blade extending across, and adapted to be positioned in pressure contact with, the width of said photosensitive surface, and apparatus for detecting said sheet material which remains on said photosensitive surface after transfer, said apparatus comprising an energy transmitting and receiving assembly, means for supporting said assembly between said transfer station and said cleaning station, and electrical circuitry responsive to a signal output for indicating the presence of said sheet material on said photosensitive surface between said transfer station and said cleaning station, the improvement comprising:

delay circuit means responsive to said assembly output signal for providing a delayed output signal, the delay being significantly less than a full drum rotation; and said electrical circuitry including means responsive to the delayed output signal for terminating movement of the photosensitive surface, the time duration delay of said delayed signal being sufficiently long to enable at least the leading edge of said sheet material to contact said cleaning station wiper blade prior to termination of said photosensitive surface movement, whereby a buckle is created in said sheet material between said transfer station and said cleaning station wiper blade for facilitating removal of said sheet material from said copier.

6. In a photocopier having a transfer station for transferring a developed image from a photosensitive recording surface onto a sheet material and then removing the sheet material from said photosensitive surface, a cleaning station for removing developer material remaining on said photosensitive surface after transfer, said cleaning station having a wiper blade extending across, and adapted to be positioned in pressure contact with, the width of said photosensitive surface, and apparatus for detecting said sheet material which remains on said photosensitive surface after transfer, said apparatus comprising an energy transmitting and receiving assembly, means for supporting said assembly between said transfer station and said cleaning station, and electrical circuitry responsive to a signal output for indicating the presence of said sheet material on said photosensitive surface between said transfer station and said cleaning station, the improvement comprising:

delay circuit means responsive to said assembly output signal for providing a delayed output signal, said electrical circuitry including means responsive to the delayed output signal for terminating movement of the photosensitive surface, the time duration delay of said delayed signal being sufficiently long to enable at least the leading edge of said sheet material to contact said cleaning station wiper blade prior to termination of said photosensitive surface movement, and means for pivoting said assembly from an operative position adjacent, but not in contact with, said photosensitive recording surface to an inoperative position spaced from said surface, whereby a buckle is created in said sheet material between said transfer station and said cleaning station wiper blade for facilitating removal of said sheet material from said copier when said assembly is in said inoperative position.

7. The apparatus of claim 6 wherein said energy transmitting and receiving assembly comprises:

an infrared transmitting and receiving assembly including transmitting and receiving element surfaces; and at least one field of view limiting element extending from said infrared assembly toward said photosensitive surface for limiting the field of view of said infrared assembly and for protecting said transmitting and receiving element surfaces from being covered with developer material which remains on said photosensitive surface during normal operation of said copier.

8. In a photocopier having a transfer station for transferring a developed image from a photosensitive recording surface onto a sheet material and for removing said sheet material from said photosensitive surface, said surface forming the outside periphery of a rotating drum member, a cleaning station for removing liquid developer material remaining on said surface after transfer, said cleaning station having a wiper blade extending across, and adapted to be positioned in pressure contact with, the width of said photosensitive surface, and apparatus for detecting said sheet material which remains on said photosensitive recording surface of said electrostatic copier after transfer, said apparatus comprising an energy transmitting and receiving assembly, means for supporting said assembly between said transfer station and said cleaning station, and electrical circuitry responsive to a signal output from said assembly for providing a detection signal output indicating the presence of said sheet material on said photosensitive surface between said transfer station and said cleaning station, the improvement comprising:

a delay circuit responsive to said assembly output signal for providing a delayed output signal;

said electrical circuit including means responsive to said delayed output signal for terminating movement of said photosensitive surface, the time duration delay of said delayed signal being sufficiently long for enabling at least the leading edge of said sheet material to contact said cleaning station wiper blade prior to termination of said photosensitive surface movement;

means for pivoting said assembly from an operative position adjacent, but not in contact with, said photosensitive recording surface to an inoperative position spaced apart from said surface;

said energy transmitting and receiving assembly comprising an infrared transmitting and receiving assembly including transmitting and receiving element surfaces, and at least one field of view limiting element extending from said infrared assembly toward said photosensitive recording surface for limiting the field of view of said infrared assembly and protecting said transmitting and receiving element surfaces from being covered with developer material which remains on said surface during normal operation of said copier, whereby a buckle is created in said sheet material between said transfer station and said cleaning station wiper blade when the movement of said photosensitive surface terminates and sheet removal is facilitated by said buckle and by moving said assembly to said inoperative position.

* * * * *